United States Patent [19]

Maruyama et al.

[11] Patent Number: 4,469,990

[45] Date of Patent: Sep. 4, 1984

[54] ELECTRONIC FLASH DEVICE

[75] Inventors: Yuji Maruyama; Katsumi Horinishi, both of Osaka, Japan

[73] Assignee: West Electric Co., Ltd., Osaka, Japan

[21] Appl. No.: 449,633

[22] Filed: Dec. 14, 1982

[30] Foreign Application Priority Data

Dec. 14, 1981 [JP] Japan ..... 56-202169

[51] Int. Cl.[3] ..... H05B 41/32

[52] U.S. Cl. ..... 315/241 P; 315/173; 315/225

[58] Field of Search ..... 315/225, 241 P, 171–173; 354/145, 149

[56] References Cited

U.S. PATENT DOCUMENTS 4,272,806 6/1981 Metzger ..... 315/241 P X

*Primary Examiner*—Eugene R. LaRoche

*Attorney, Agent, or Firm*—Burgess, Ryan & Wayne

[57] ABSTRACT

In an electronic flash device of the type having a power supply unit comprising a low DC power supply and a DC-DC converter and an IC memory which can maintain its stored information even if when a power supply switch is turned off, there are provided a backup capacitor which can maintain the normal and stabilized operation of the IC memory which is connected to the power supply even when the voltage of the power supply drops to such a level that the normal and stabilized operation of the IC memory cannot be maintained; a voltage detecting means for detecting the voltage across the power supply; and a control circuit which responds to the output signal from the voltage detecting means so as to control the operation of the DC-DC converter.

4 Claims, 1 Drawing Figure

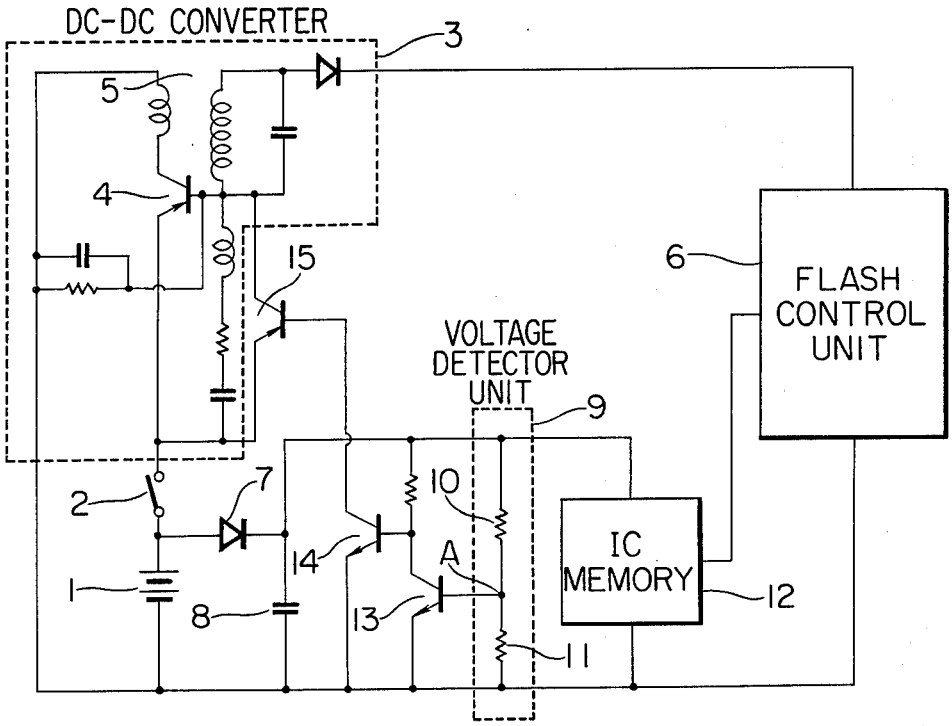
DC-DC CONVERTER
3
5
4
15
6
FLASH CONTROL UNIT
VOLTAGE DETECTOR UNIT
9
2
7
10
14
A
IC MEMORY
12
1
8
13
11

ELECTRONIC FLASH DEVICE

BACKGROUND OF THE INVENTION

The present invention relates to an electronic flash device.

There has been invented and used an electronic flash device which, instead of displaying by means of an indicator dial or panel, digitally displays an f-number and a speed of film used so that these exposure data can be easily seen and set to predetermined values by means of a shift switch.

In the case of the electronic flash device of the type described, the preselected f-number and film speed must be stored even when a main or power supply switch is turned off so as to stop a flash exposure temporarily. Therefore, the electronic flash device of the type described above is usually provided with an independent power supply which is not affected by the operation of the main or power supply switch. As a result, the electronic flash device of the type described inevitably becomes large in size because there must be provided a space for housing the independent power supply. In addition, because of the provision of the independent power supply, the cost of the electronic flash device becomes high.

In order to solve these problems, the same inventors have proposed an electronic flash in which the power can be normally supplied from a power supply of the electronic flash device to an integrated-circuit memory which stores therein predetermined exposure data such as an f-number and a film speed.

However, the power supply of the electronic flash device generally consists of a plurality of dry batteries. It follows, therefore, that when the main or power supply switch is closed when a main flash capacitor has not been charged yet, a conventional DC-DC converter is energized and consequently the voltage of the power supply drops suddenly to a low level. Therefore, when a common power supply is used for energizing the DC-DC converter and the integrated-circuit memory, the electronic flash device becomes advantageous in size and cost over the conventional electronic devices in which independent power supplies are provided for energizing the DC-DC converter to charge a main flash capacitor and for maintaining the exposure information stored in the integrated-circuit memory. However, when the voltage of the common power supply drops suddenly to a low level as described above, the exposure information stored in the integrated-circuit memory is erased.

In order to solve this problem, there has been proposed an electronic flash device in which a capacitor which is generally called a backup capacitor is connected across the common power supply in order to compensate for the voltage drop thereacross. However, the backup capacitor must have a high value so that the electronic flash device becomes large in size because it must house the backup capacitor and becomes also expensive to fabricate.

OBJECTS OF THE INVENTION

The primary object of the present invention is, therefore, to solve the above and other problems encountered in the conventional electronic flash devices.

To this end, the present invention provides an electronic flash device in which a common power supply is provided for energizing a DC-DC converter so as to charge a main flash capacitor and maintaining the exposure information stored in an integrated-circuit memory and which is further provided with a means for detecting the voltage across the common power supply and a means for suspending the operation of the DC-DC converter when the voltage across the common power supply drops below a predetermined level, whereby the value of a backup capacitor can be decreased considerably as compared with the conventionally used backup capacitors.

BRIEF DESCRIPTION OF THE DRAWING

A single FIGURE shows an electric circuit diagram of a preferred embodiment of an electronic flash device in accordance with the present invention.

DESCRIPTION OF THE PREFERRED EMBODIMENT

In the single FIGURE illustrating the electric circuit diagram of an electronic flash device in accordance with the present invention, reference numeral 1 designates a power supply; 2, an ON-OFF switch; 3, a conventional DC-DC converter consisting of a transistor 4, a transformer 5 and so on; 6, a flash control unit consisting of a main flash capacitor, a flash lamp, a trigger circuit and so on; 7, a diode; 8, a backup capacitor with a small value; 9, a voltage detector unit which consists of resistors 10 and 11 and a transistor 13 and is adapted to check the voltage of the power supply 1 through the capacitor 8; 12, an IC memory; and 14 and 15, transistors which constitute a control circuit for interrupting the operation or oscillation of the DC-DC converter 3.

It should be noted that the power is always supplied from the power supply 1 through the diode 7 and the backup capacitor 8 to the IC memory 12; that is, the IC memory 12 is not connected to the power supply 1 through the ON-OFF switch 2.

When the ON-OFF switch 2 is turned on or closed when the main flash capacitor (not shown) has not yet been charged, the DC-DC converter 3 is energized so that the voltage across the power supply 1 suddenly drops.

Such sudden voltage drop across the power supply 1 as described above is caused even when the backup capacitor 8 is provided and is reflected as variation in voltage at the junction A between the resistors 10 and 11 in the voltage detector unit 9.

The junction A is connected to the base of the transistor 13 which in turn controls the operation of the transistor 14 in the control circuit, so that the operation of the transistor 13 is dependent upon the voltage at the junction A. That is, the voltage at the junction A controls the transistor 13. According to the present invention, the voltage at the junction A is so selected that if the voltage across the power supply 1 drops to such a level that malfunction of the IC memory 12 follows, the transistor 13 is driven into the nonconducting state. In this case, the backup operation of the backup capacitor 8 is, of course, taken into consideration.

That is, according to the present invention, when the voltage drop across the power supply 1 is such that malfunction of the IC memory 12 occurs, the voltage detector 9 drives the transistor 13 into the nonconducting state, the transistor 13 controlling the transistor 14 in the circuit for controlling the operation of the DC-DC converter 3.

Even when the transistor 13 is driven into the nonconducting state; that is, even when the voltage across the power supply 1 drops below a predetermined level as described above, a voltage of a certain value is supplied to the IC memory 12 because of the voltage across the backup capacitor 8 so that the normal operation of the IC memory 12 can be satisfactorily maintained.

When the transistor 13 is driven into the nonconducting state, the base-emitter voltage of the transistor 14 rises so that the transistor 14 is driven into the conduction state. As a result, a loop for supplying a current to the base of the transistor 15 is established so that the transistor 15 is also driven into the conduction state. As a consequence, the base and emitter of the transistor 4 in the DC-DC converter 3 are short-circuited so that the transistor 4 is forced into the nonconducting state.

As a result, the DC-DC converter 3 is de-energized so that the supply of energy through the ON-OFF switch 2 to the flash control unit 6 is interrupted.

Then, the voltage across the power supply 1 can return to its normal level. When the normal function of the IC memory 12 is thus ensured, the transistor 13 in the voltage detector unit 9 is driven into the conduction state and consequently the transistors 14 and 15 are again driven into the nonconducting state. Consequently, the DC-DC converter 3 is again energized.

When the level of the voltage across the power supply 1 is sufficiently high so that the normal operation of the IC memory 12 can be maintained, the voltage at the junction A in the voltage detector unit 9 is also maintained at a high level. As a result, the transistors 14 and 15 cannot be driven into the conduction state. If the ON-OFF switch 2 is kept closed, the operation of the DC-DC converter 3 continues.

If the voltage drop across the power supply 1 is such that the normal operation of the IC memory 12 cannot be maintained when the ON-OFF switch is turned on while the main flash capacitor has not yet charged, the above described operation is repeated. That is, at the initial period when the charging of the main flash capacitor is started so that the voltage drop across the power supply 1 is relatively high, the energy is intermittently supplied to the DC-DC converter 3. But when the voltage across the power supply 1 is above a predetermined level, the energy is continuously supplied to the DC-DC converter 3.

One may think that if the above-described operation is carried out, it would take a longer time period to charge the main flash capacitor to a predetermined level. In practice, the time delay is of the order of about 0.2 seconds, which can be regarded as being within the negligible or tolerable measurement error range.

According to the present invention, the backup capacitor 8 has a small value. The reasons are as follows: Since the operation of the DC-DC converter 3 is controlled in the manner described above, it suffices to supply a voltage to the IC memory 12 so that the same can maintain its normal operation from the time when the quick voltage drop across the power supply 1 occurs to the time when the DC-DC converter 3 is de-energized by the voltage detector unit 9 and the control circuit (14 and 15) so that the voltage across the power supply 1 is returned to a normal level at which the normal operation of the IC memory 12 can be maintained. Furthermore, the voltage detector unit 9 operates electrically and therefore for an extremely short time period. As a result, the electronic flash device in accordance with the present invention can be made compact in size and fabricated at less costs.

What is claimed is:

1. An electronic flash device, comprising;

a power supply;

an ON-OFF power switching means in series with said power supply;

a DC-DC converter connected to said power supply via said switching means and energized when said ON-OFF switching means is closed;

a series circuit comprising a diode and a capacitor connected across said power supply without passing through said ON-OFF switching means, so that the voltage across said capacitor corresponds to the power supply voltage;

a solid-state memory connected across said capacitor for storing flash parameters; and voltage detecting means for generating an output signal indicative of the voltage across said capacitor, said voltage detecting means including circuit means responsive to said output signal for disabling said DC-DC converter only when said said output signal indicates the voltage across said capacitor is below a predetermined threshold value sufficient to maintain normal operation of said memory connected across said capacitor.

2. An electronic flash device as set forth in claim 1, wherein said capacitor has a value sufficient to maintain normal and stabilized operation of said memory even when the voltage across said power supply drops below said predetermined threshold value.

3. An electronic flash device as set forth in claim 2, wherein said voltage detecting means comprises;

(a) a plurality of series-connected voltage-dividing resistors connected across said capacitor, and (b) a first switching means controlled by a voltage derived from said voltage-dividing resistors for switching from the conducting state into the nonconducting state when the voltage across said power supply drops to such a level that normal and stabilized operation of said memory cannot be maintained.

4. An electronic flash device as set forth in claim 3 wherein said DC-DC converter includes an oscillator transistor having a control electrode, and said control circuit includes second switching means connected to said control electrode for switching into the conduction state when the first switching means is driven from the conducting state to the nonconducting state, for short-circuiting any signal at said control electrode to disable said DC-DC converter.

* * * * *